United States Patent [19]

Mena

[11] Patent Number: 5,022,223

[45] Date of Patent: Jun. 11, 1991

[54] METHOD OF AND APPARATUS FOR AUTOMATICALLY EXCHANGING BOBBINS AT A FLYER

[75] Inventor: Jose Mena, Bülach, Switzerland

[73] Assignee: Maschinenfabrik Rieter AG, Winterthur, Switzerland

[21] Appl. No.: 407,410

[22] Filed: Sep. 14, 1989

[30] Foreign Application Priority Data

Sep. 23, 1988 [CH] Switzerland ..... 03546/88
Jun. 22, 1989 [CH] Switzerland ..... 02322/89

[51] Int. Cl.[5] ..... D01H 9/04

[52] U.S. Cl. ..... 57/267; 57/274; 57/276; 57/281

[58] Field of Search ..... 57/266, 267, 270, 271, 57/274, 275, 276, 277, 281

[56] References Cited

U.S. PATENT DOCUMENTS 3,059,405 10/1962 Ingham ..... 57/275 X
3,808,788 5/1974 Viglione ..... 57/275
3,895,482 7/1975 Schulz et al. ..... 57/275
3,990,222 11/1976 Marzoli ..... 57/276 X
4,313,299 2/1982 Günkinger et al. ..... 57/277 X
4,369,621 1/1983 Kogiso ..... 57/274 X
4,389,840 6/1983 Briner et al. ..... 57/267
4,757,679 7/1988 Marzoli ..... 57/267

FOREIGN PATENT DOCUMENTS 0303877 2/1989 European Pat. Off. .
0310568 4/1989 European Pat. Off. .
2158657 6/1972 Fed. Rep. of Germany ..... 57/274
2155510 9/1985 United Kingdom ..... 57/281

*Primary Examiner*—Joseph J. Hail, III
*Attorney, Agent, or Firm*—Sandler, Greenblum & Bernstein

[57] ABSTRACT

The doffing time of a flyer can be considerably shortened when a carrier carrying empty bobbins is brought in a single sequence of movements, without interim or intermediate storing, from a substantially vertical transport-starting position into a predetermined inclined position and thus into alignment with an inclined bobbin rail. The full bobbins are accordingly conveyed in analogous manner.

4 Claims, 6 Drawing Sheets

FIG 8
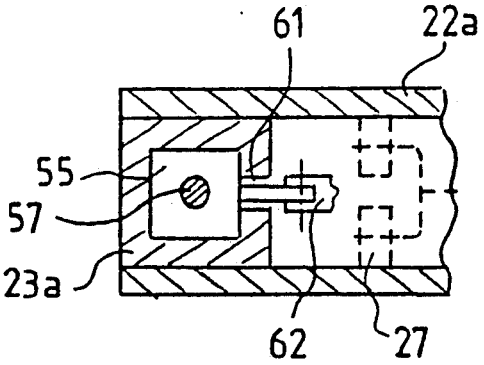
FIG 9
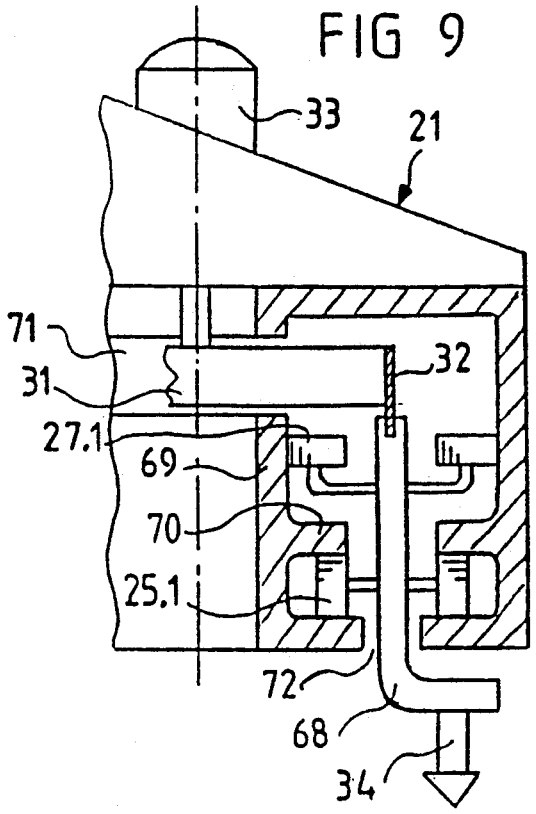
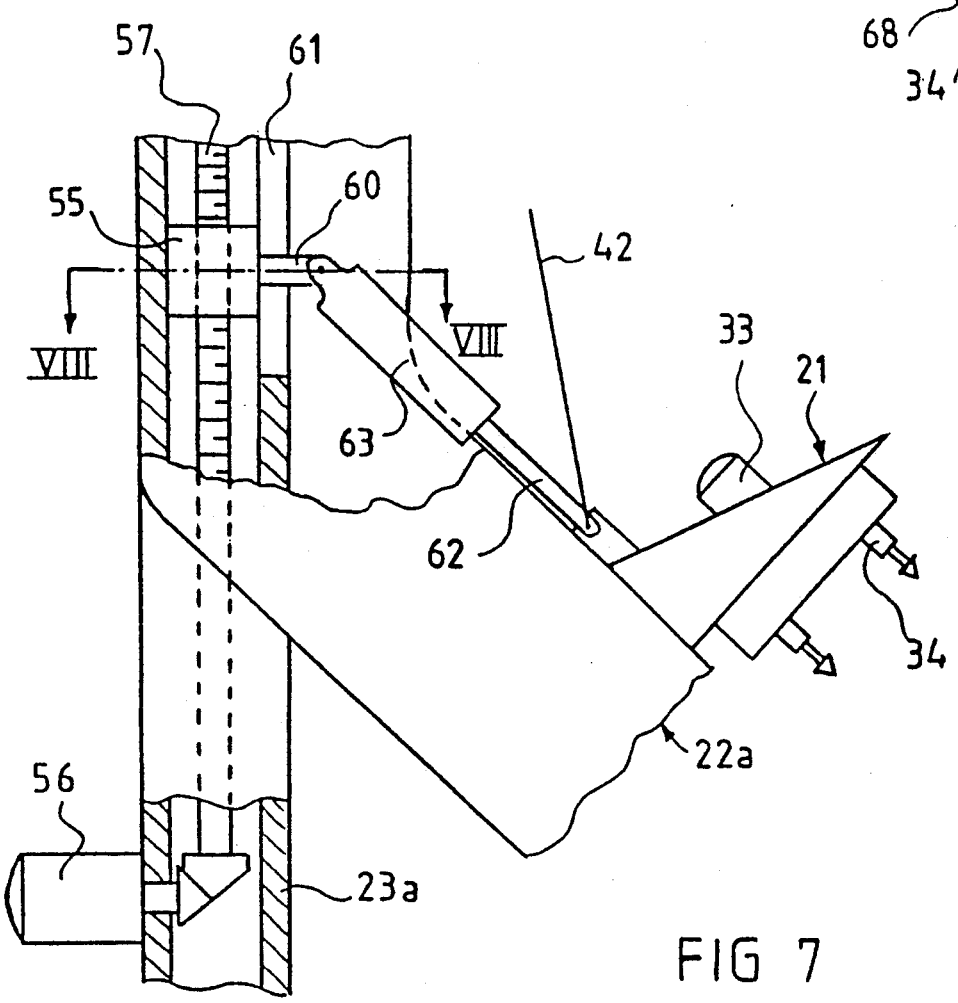
FIG 7

FIG 15
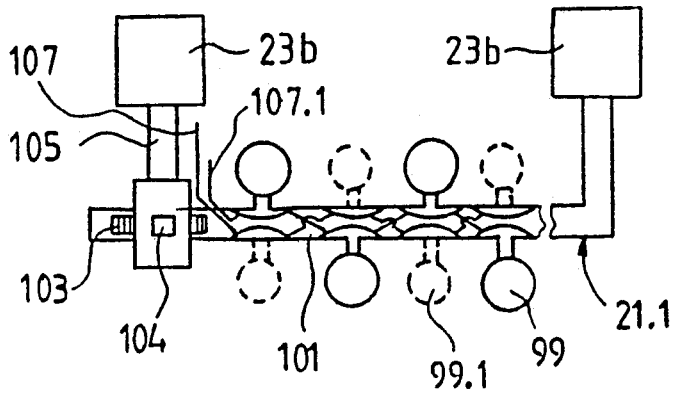
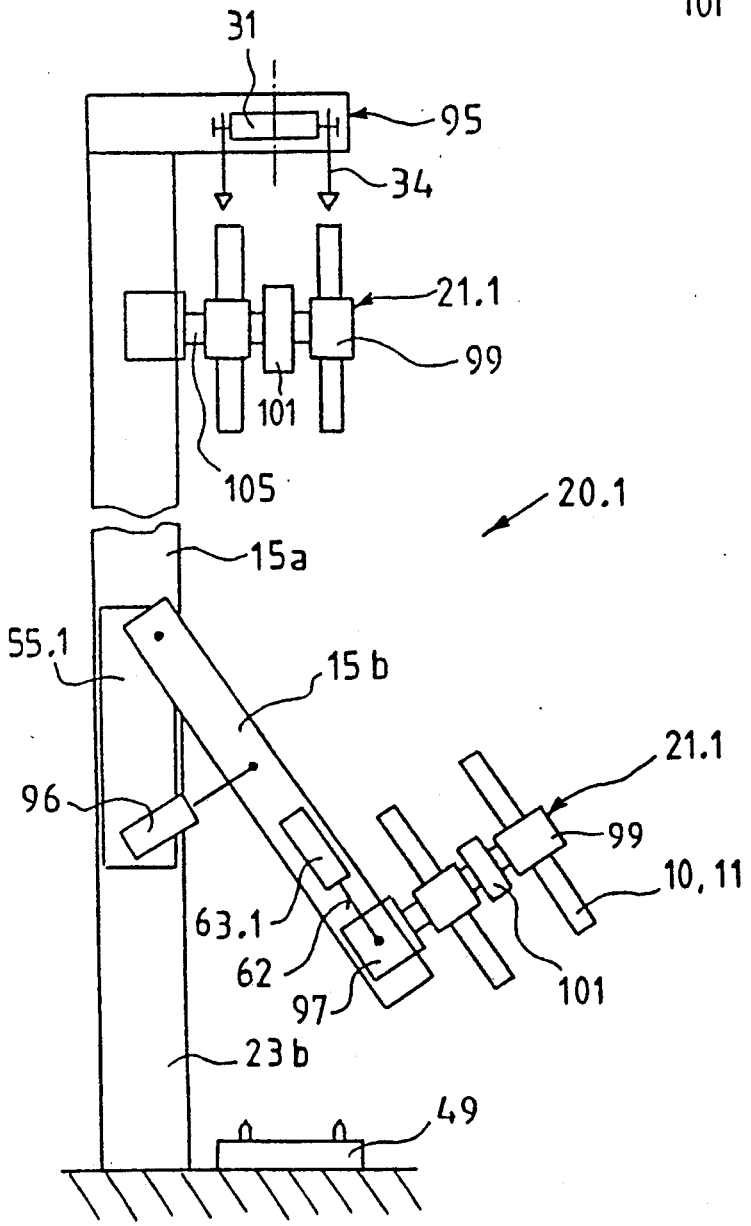
FIG 14

METHOD OF AND APPARATUS FOR AUTOMATICALLY EXCHANGING BOBBINS AT A FLYER

BACKGROUND OF THE INVENTION

The present invention broadly relates to the process of replacing full bobbins by empty bobbins at a spinning machine and pertains, more specifically, to a new and improved method of automatically exchanging full bobbins for empty bobbins at a flyer, i.e. a flyer frame or roving frame. The present invention also relates to a new and improved apparatus for automatically exchanging full bobbins for empty bobbins at a flyer, i.e. a flyer frame or roving frame.

Generally speaking, the present invention relates to a new and improved method of the type as described and which method may encompass the steps of tilting the full bobbins out of their substantially vertical operating position into an inclined position, lifting the full bobbins in their inclined position to doff the full bobbins and bringing the full bobbins into a substantially vertical position. The method includes in analogous manner the steps of tilting the empty bobbins out of a substantially vertical position into an inclined position, lowering the empty bobbins in the inclined position and bringing the empty bobbins into their substantially vertical operating position. The replacement of full bobbins by empty bobbins is accomplished by a doffing apparatus separate from the flyer.

In a known apparatus for automatically doffing cops or full bobbins and replacing them with empty tubes, the predecessor of which is disclosed, for example, in U.S. Pat. No. 4,757,679, granted Jul. 19, 1988, the empty tubes are suspended at a carrier with integrated transit beam in the transport-starting position, the empty tubes having been transferred to the carrier from the suspension transport means arriving from a ring spinning machine. In substantially vertical downward travel, the carrier positions the empty tubes in two lengthwise rows at an interim or intermediate storing conveyor in the lower part of the roving frame and extending along the face of and substantially parallel to the latter, i.e. upon a conveyor comprising a plurality of pegs and displaceable by one half the longitudinal pitch between the axes of adjacent cops. The carrier is then again lifted. The conveyor is displaced by a half of the pitch with respect to the arrangement or layout of the full bobbins in the flyer. Substantially at the level of the flyer support bed, the flyer comprises a horizontally disposed guide bar which extends over the entire length of the machine and projects at one end therefrom by a certain distance, and a doffing carriage is mobile along the entire machine face by means of the aforesaid guide bar.

In the vertical position the doffing carriage is aligned with the interim or intermediate storing conveyor and can be brought by means of a lever construction into an inclined position in which it defines an acute angle to the flyer. In this inclined position the doffing carriage is aligned with a cop carrier which has been lowered from the operating or spinning position and tilted into an inclined position, and which cop carrier holds at spindles the full bobbins to be replaced by empty tubes. At the lower end of its pneumatic cylinder the doffing carriage has twelve gripping elements by means of which it doffs the full bobbins or cops from the cop carrier in groups and places them on the pegs of the interim storing conveyor between the empty bobbins or tubes which are already present thereupon. When the whole flyer has been cleared the interim storing conveyor is again displaced by a half pitch, i.e. by one half the longitudinal distance between the axes of adjacent full bobbins. The doffing carriage is now in a position to lift the empty bobbins or tubes by groups from the interim storing conveyor, to bring them into the inclined position and to deposit them onto the spindles at the cop carrier. The cop carrier with the complete number of empty bobbins or tubes again tilts into the substantially horizontal position and is vertically lifted into the correct position for commencement of spinning. The carrier then is again lowered in order to engage the full bobbins at the interim storing conveyor and to vertically convey them into their upper removal or discharge position. From this removal or discharge position the full bobbins or cops are plugged onto transport means by a pivotable lever arm in order to supply subsequent ring spinning machines with roving bobbins.

The mode of operation by groups of the doffing carriage, both for the full bobbins as well as for the empty bobbins, and the interim storing at the conveyor, lead to substantially long doffing times during which spinning cannot take place. Moreover, this known flyer doffer is relatively complicated and requires a corresponding constructional expenditure. The doffing carriage is displaced after use on the guide bar to one side out of the working range of the spindles and remains in this position on the flyer, whereby substantial space is required and accessibility is strongly impaired.

SUMMARY OF THE INVENTION

Therefore, with the foregoing in mind, it is a primary object of the present invention to provide a new and improved method of, and apparatus for, automatically exchanging bobbins at a flyer, and which method and apparatus do not exhibit the aforementioned drawbacks and shortcomings of the prior art.

Another and more specific object of the present invention aims at providing a new and improved method of, and apparatus for, automatically exchanging bobbins at a flyer, and which method and apparatus render possible that the doffing time can be substantially reduced.

A still further important object of the present invention is directed to a new and improved method of, and apparatus for, automatically exchanging bobbins at a flyer, and which method and apparatus permits using the simplest possible means requiring a minimum of space and substantially improving accessibility of the flyer.

Yet a further significant object of the present invention aims at providing a new and improved apparatus for automatically exchanging bobbins at a flyer, and which apparatus is of relatively simple construction and design, economical to manufacture and yet affords highly reliable operation thereof without being subject to breakdown and malfunction, and also requires a minimum of maintenance and servicing.

In keeping with the immediately preceding object, it is a further object of the present invention to provide a new and improved apparatus for automatically exchanging bobbins at a flyer, and which apparatus provides the possibility of equipping existing flyers with a doffer or doffing apparatus. In this manner, existing manually doffed flyers can be modernized, particularly flyers which have a tiltable bobbin rail or carriage.

Now in order to implement these and still further objects of the present invention which will become more readily apparent as the description proceeds, the method of the present development is manifested, among other things, by the features that all full bobbins are jointly moved out of the inclined position by means of a carrier of the doffing apparatus separate from the flyer and that all empty bobbins or tubes are jointly brought into the inclined position by means of the carrier.

As alluded to above, the invention is not only concerned with the aforementioned method aspects, but also relates to a new and improved construction of apparatus for carrying out this method. Generally speaking, the inventive apparatus comprises a flyer having a bobbin rail which can be tilted into an inclined position and which has spindles for bobbins, and a device entirely separate from the flyer. This device comprises an elevationally movable carrier with gripping means for the bobbins. The carrier extends over the full working length of the flyer.

To achieve the aforementioned measures, the inventive apparatus, in its more specific aspects, is structured such that the carrier is movable between a substantially vertical path of motion and an inclined path of motion corresponding to the inclined position of the tiltable bobbin rail.

Due to the fact that the exchange of bobbins is accomplished in one single sequence of movements, it is now rendered possible to completely do without a doffing carriage and, optionally, automatically exchange bobbins without the need for interim storing, so that the flyer can be manufactured at favorable costs. All full bobbins can be directly removed in one operation, instead of by groups, from the tiltable bobbin rail and all empty bobbins or tubes can be deposited at the tilted bobbin rail in one operation. This time-saving operation substantially improves the efficiency of the flyer. Access to the flyer can be further improved because there is actually no need for interim or intermediate storing. The favorable space-saving design of the tiltable bobbin rail can be preferably retained since the drive mechanism does not have to be decoupled. In the event of modernizing an existing flyer, it is not required that the latter be basically redesigned, provided that the bobbin rail is structured to be tiltable or, at least, outwardly movable.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein:

FIG. 7 is a fragmentary side view of the flyer doffer depicted in FIG. 1 but showing an alternative embodiment with respect to the lifting mechanism for the carrier;

FIG. 8 is a section taken substantially along the line VIII—VIII in FIG. 7;

FIG. 9 is a partial sectional view depicting in an enlarged showing a preferred embodiment of the mounting of a gripper element in the carrier depicted in FIGS. 1 and 7;

FIG. 14 is a diagrammatic side view of a second flyer doffer provided with an apparatus constructed according to the invention;

FIG. 15 is a plan view of a carrier for the second flyer doffer depicted in FIG. 14;

DETAILED DESCRIPTION OF THE PREFERRED EMBODIMENTS

Figure 1:
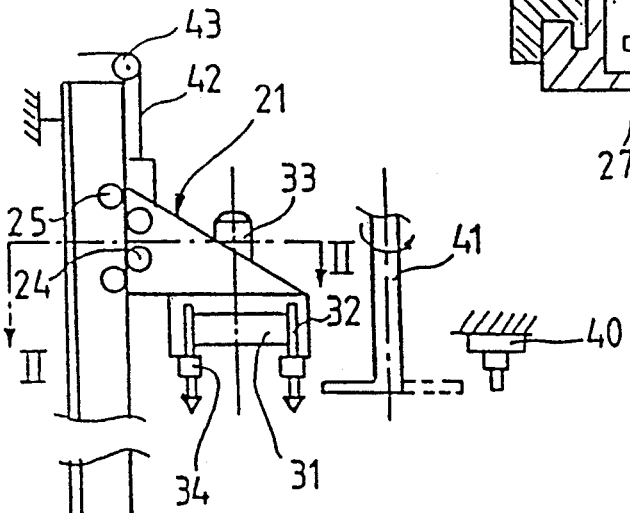
FIG. 1 is a diagrammatic side view of a flyer doffer provided with an apparatus constructed according to the invention.
Figure 1:
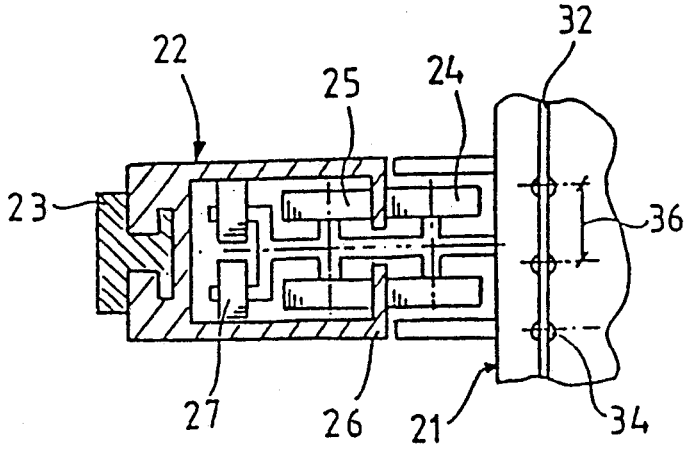

Describing now the drawings, it is to be understood that to simplify the showing thereof, only enough of the structure of the inventive apparatus for automatically exchanging bobbins at the flyer has been illustrated therein as is needed to enable one skilled in the art to readily understand the underlying principles and concepts of the present invention. Turning attention now specifically to FIG. 1 of the drawings, there is depicted therein by way of example and not limitation a flyer or roving frame 3 schematically illustrated only with a drafting unit or arrangement 4, a pair of flyers 5 and a bobbin rail 6. The bobbin rail 6 is depicted after having been lowered in a generally vertical direction out of its operating position and then tilted into an inclined position to define an acute angle to the vertical. Full bobbins 10, which are also known as roving bobbins or flyer bobbins, each consist of an empty bobbin or tube 11 with a sliver or fiber band package or cop 12 and are held by spindles 13 shown in broken lines in FIG. 1.

A carrier 21 with an integrated transit beam of a doffer or doffing or doffing and donning apparatus 20, which is entirely separate from the flyer or roving frame 3 and extends over the entire working length thereof, i.e. across the entire range of spinning locations of the flyer or roving frame 3, is movable or displaceable along at least two angular one-piece slide rails or tracks 22 which are bent away in the direction of the tilted bobbin rail 6 and supported by sectional supports 23 at the machine floor or base 29. Each slide rail or track 22 comprises a substantially vertical path of motion 15*a* and an inclined path of motion 15*b* which defines the same acute angle to the vertical as the inclined position of the full bobbins at the tilted bobbin rail 6.

Figure 2:
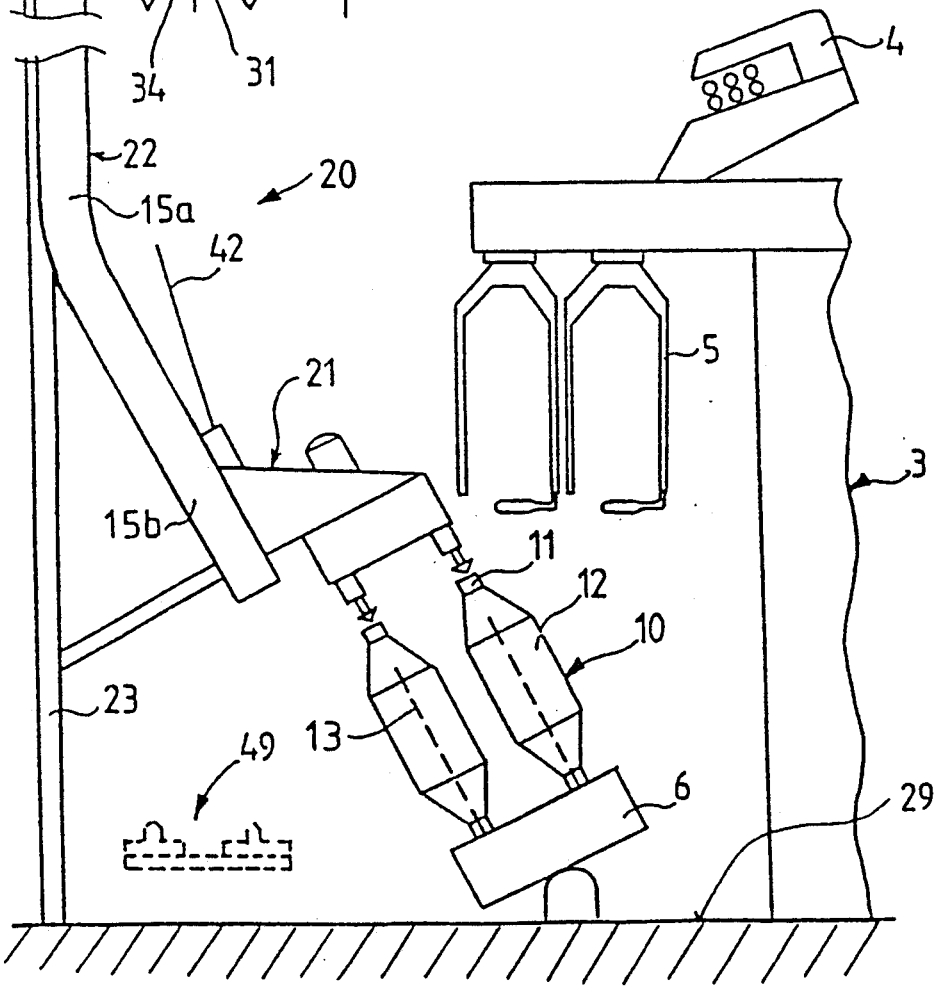
FIG. 2 is a section taken substantially along the line II—II in FIG. 1.

FIG. 2 depicts in a sectional view taken substantially along the line II—II of FIG. 1 and in top plan view and on an enlarged scale an exemplary embodiment of an extruded section of a slide rail or track 22. It is readily conceivable that the carrier 21 is movable at the associated slide rail or track 22 by means of rolls or rollers 24 at the outer side or surface of an open cross-piece 26 of the associated slide rail or track 22, by means of rolls or rollers 25 at the inner side or surface of the open cross-piece 26 as well as by means of lateral guide rolls or rollers 27. The carrier 21 comprises an endless band or belt 32 which is tensioned around two deflection rolls or rollers 31 and is movable by means of a suitable drive motor 33. Holding or retaining means in the form of gripping elements 34, which will be described in greater detail in conjunction with FIG. 9, are secured at the endless band or belt 32 and arranged in a spaced relationship to one another by half a pitch 36 relative to the pitch 35 of the bobbins 10 or 11 at the tiltable bobbin rail 6 and in the spinning positions or locations, so that the gripping elements 34 are arranged with a density double that of the spinning positions or locations.

At the top or upper portion of FIG. 1 the carrier 21 is located in the discharge position for the full bobbins 10, which position is likewise the delivery-starting position for the empty bobbins or tubes 11. A suspended transport device 40 well known to the art is also arranged at this substantially vertical position. A pivotable lever arm 41 is provided for changing the position of the full bobbins 10 from the carrier 21 to the suspended transport device 40, and the position of the empty bobbins or tubes 11 from the suspended transport device 40 to the carrier 21.

Having now had the benefit of the foregoing discussion of the first exemplary embodiment of the apparatus for automatically exchanging bobbins, its mode of operation will now be described in conjunction with FIGS. 3 through 6 and is as follows:

The full bobbins 10 are to be replaced by the empty bobbins or tubes 11. The full bobbins 10 are lowered with the bobbin rail 6 in a substantially vertical direction and brought into the inclined position which defines an acute angle to the vertical. The empty bobbins or tubes 11 are now located at the carrier 21 in the delivery-starting position. The carrier 21 together with the empty bobbins or tubes 11 is lowered initially or at first in a substantially vertical direction and then, by virtue of the angular shape of the slide rails or tracks 22, in an oblique direction into the inclined position. This downward travel is effected by means of at least two cables or ropes 42 which are slung or trained around deflection rolls or rollers 43. Thus the empty bobbins or tubes 11 are lowered into the inclined position thereof in a continuous sequence of movements without interim or intermediate storing.

Figure 3A:
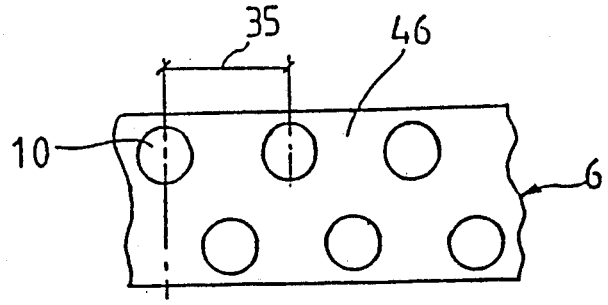
FIG. 3*a* is a partial plan view of the bobbin rail at a first stage of the inventive method.
Figure 3B:
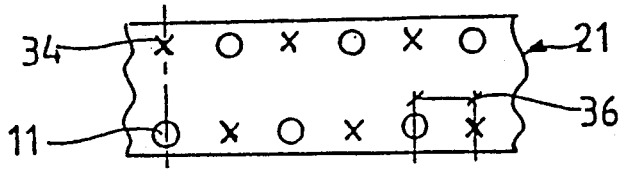
FIG. 3*b* is a partial plan view of the carrier in a corresponding superimposed position relative to the first stage of the inventive method.
Figure 4A:
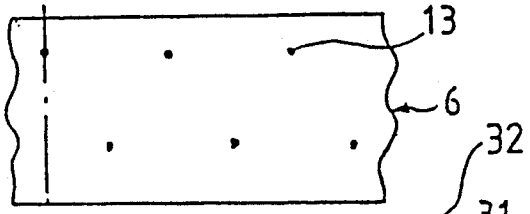
FIG. 4*a* is a partial plan view of the bobbin rail at a second stage of the inventive method.
Figure 4B:
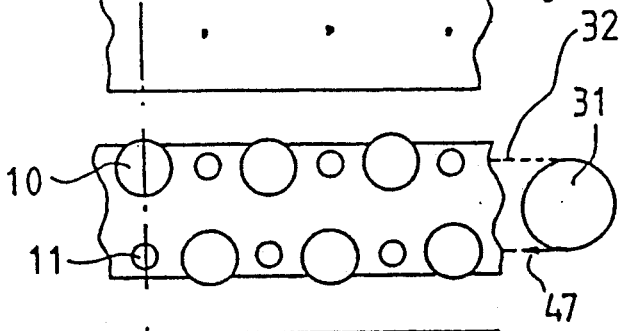
FIG. 4*b* is a partial plan view of the carrier in a corresponding superimposed position relative to the second stage of the inventive method.
Figure 5A:
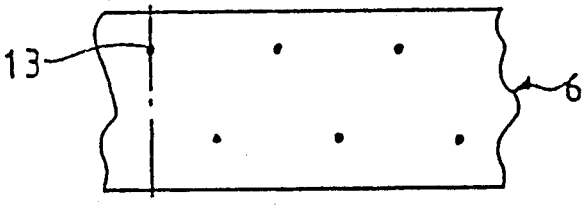
FIG. 5*a* is a partial plan view of the bobbin rail at a third stage of the inventive method.
Figure 5B:
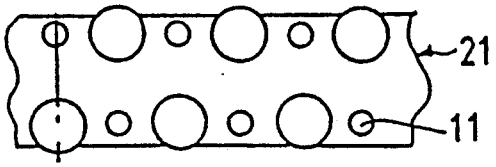
FIG. 5*b* is a partial plan view of the carrier in a corresponding superimposed position relative to the third stage of the inventive method.
Figure 6A:
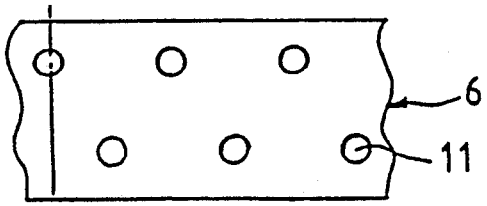
FIG. 6*a* is a partial plan view of the bobbin rail at a fourth stage of the inventive method.
Figure 6B:
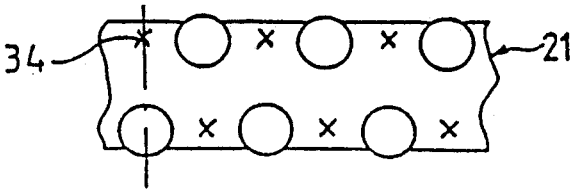
FIG. 6*b* is a partial plan view of the carrier in a corresponding superimposed position relative to the fourth stage of the inventive method.
Figure 18:
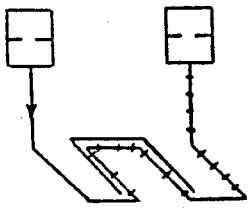
FIG. 18 is a diagram showing the sequence of movements during the doffing procedure carried out without the aid of interim storing in the flyer doffer depicted in FIGS. 1 and 7.

The empty gripping elements 34 of the carrier 21 are aligned during the continuous sequence of movements with the full bobbins 10. In this manner, the empty bobbins or tubes 11 move into empty spaces 46 located between the full bobbins 10 as depicted in FIG. 3. The empty gripping elements 34 now grip or engage the full bobbins 10. In this inclined position the carrier 21 with full bobbins 10 and empty bobbins or tubes 11 is raised above the spindles 13 (FIG. 5*a*). The motor or drive means 33 is then set in motion and displaces the endless band or belt 32 by the half pitch 36 in the direction of the arrow 47 as shown in FIGS. 4*b* and 5*b*. The empty bobbins or tubes 11 are now aligned with the spindles 13. The carrier 21 is again lowered into the inclined position and deposits the empty bobbins or tubes 11 onto the spindles 13 at the respective working positions. The carrier 21 now contains only the full bobbins 10 located in the inclined position as shown in FIG. 6*b*. The full bobbins 10 are now lifted or conveyed out of this inclined position in a continuous movement, i.e. without interim or intermediate storing, into the substantially vertical discharge position. The carrier 21 thus simultaneously serves as an intersection location for the empty bobbins or tubes 11 and for the full bobbins 10. The interim or intermediate storing location 49 shown in broken lines in FIG. 1 is thus unnecessary in this first exemplary embodiment of the apparatus for automatically exchanging bobbins. This process or sequence of movements is diagrammatically illustrated in FIG. 18.

In the exemplary embodiment of FIG. 7, which is a variant of the first exemplary embodiment of the apparatus for automatically exchanging bobbins, the lifting mechanism for the carrier 21 is realized or effected by means of a substantially vertically adjustable slide block 55. This slide block 55 and a threaded or screw spindle 57, which serves for elevational adjustment and is driven by a suitable motor 56, are integrated in a substantially vertical sectional support 23*a*. Form-locked spindles, toothed racks, bands and the like could be used in place of the threaded or screw spindle 57. The adjustable slide block 55 comprises a lug 60 which projects through a vertical opening or slot 61 of the substantially vertical sectional support 23*a*. A hinged rod 62 connects the lug 60 to the carrier 21, optionally in conjunction with a cylinder 63. Reliable downward travel of the carrier 21 is ensured by this alternative embodiment. The cables or ropes 42 tensioned or trained over deflection rolls or rollers 43 can be retained for the purpose of weight compensation for the carrier 21. In FIG. 8, the positions of the lateral guide rolls or rollers 27 are indicated by broken lines within the slide rail 22*a* which is slightly modified with respect to the construction depicted in FIG. 2.

Reliable operation or functioning of the apparatus constructed according to the invention is determined to a very great extent by rigid guides or guidances. FIG. 2 depicts a suitable manner of guiding the carrier 21 at the angular slide rails or tracks 22 or 22*a* (FIG. 8). The gripping elements 34 must also be rigidly guided, for example, as shown in FIG. 9. The gripping elements 34 are connected with the endless band or belt 32 by means of gripper holders 68. In an analogous manner with respect to the construction in FIG. 2, rolls or rollers 25.1 and lateral guide rolls or rollers 27.1 bear against a sectional rail or track 69. Rolls or rollers 24.1 are not provided due to the provision of ribs 70 at the sectional rail or track 69. This sectional rail or track 69 advantageously encloses the full length of the endless band or belt 32, with horizontal cut-outs 71 being provided for the deflection rolls or rollers 31. The gripper holders 68 project from the sectional rail or track 69 through a continuous slot 72 located at the lower portion of the sectional rail or track 69.

Figure 10:
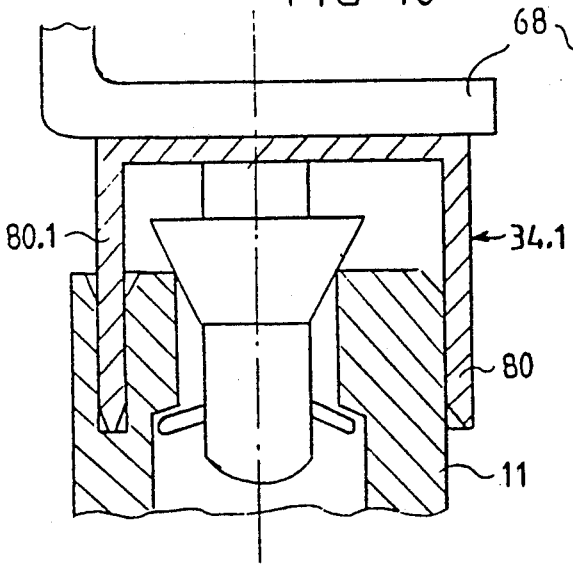
FIG. 10 is a section through a first exemplary embodiment of a gripper-bobbin connection in a flyer doffer as depicted in FIGS. 1 or 7.

The connection between the gripping element 34 and the empty bobbin or tube 11 also must be structured to be rigid and inflexible. FIGS. 10 through 13 show possible exemplary embodiments of such connections. The right-hand half of FIG. 10 shows a gripping element 34.1 with a stiffener or support means in the form of an optionally interrupted cylindrical jacket or shell 80 which partially extends over the length of the full bobbin 10 or the empty bobbin or tube 11. The left-hand half of FIG. 10 shows a cylindrical jacket or shell 80.1 which can penetrate into the end face of the empty bobbin or tube 11.

Figure 11:
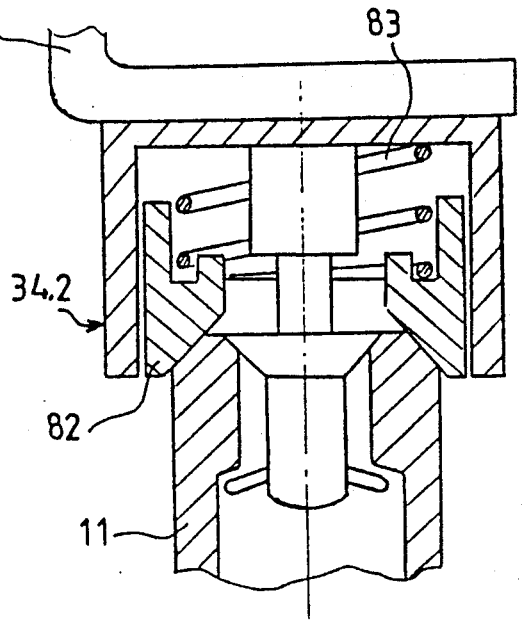
FIG. 11 is a section through a second exemplary embodiment of a gripper-bobbin connection in a flyer doffer as depicted in FIGS. 1 or 7.
Figure 12:
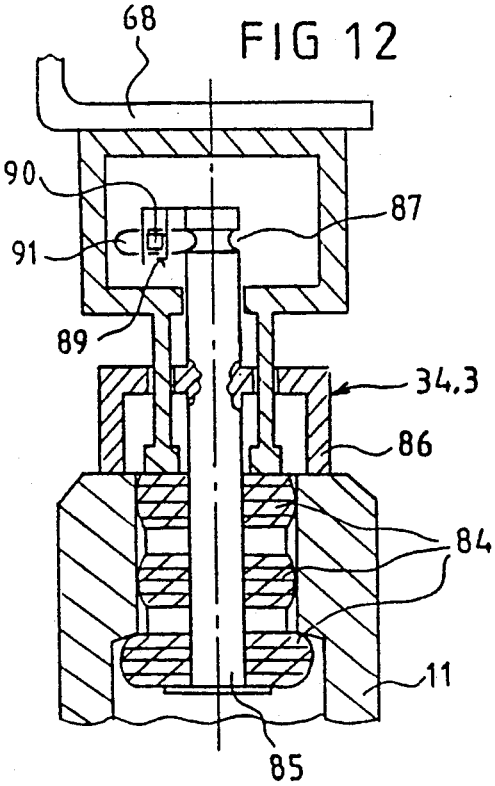
FIG. 12 is a section through a third exemplary embodiment of a gripper-bobbin connection in a flyer doffer as depicted in FIGS. 1 or 7.
Figure 13:
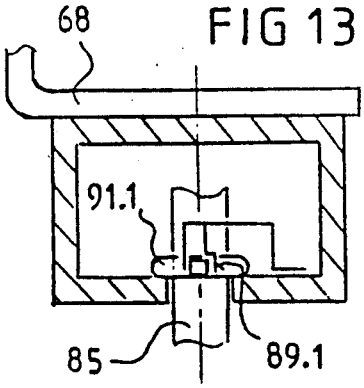
FIG. 13 is a partial section through a part of the third exemplary embodiment of the gripper-bobbin connection as illustrated in FIG. 12 and incorporating a modification of a portion of the gripper-bobbin connection.

FIG. 11 shows a gripping element 34.2 with support means in the form of a pressure body 82 which bears upon the end face of the empty bobbin or tube 11. This pressure body 82 is retained by a spring 83. FIG. 12 shows a gripping element 34.3, the stiffener of which was inspired by a bottle stopper. Elastic rings 84 on a pin or bolt 85 expand at the inner side or wall of the empty bobbin tube 11, while an outer member 86 at the pin or bolt 85 bears upon the end face of the empty bobbin or tube 11. The pin or bolt 85 possesses an annular recess 87 and a spring element 89 which cooperates with a square element 90 of a latch 91. The latch 91 is firmly but rotatedly connected to the gripper holder 68 in such a manner that the spring element 89 turns the square element 90 and thus the latch 91 through 90° during upward travel or movement of the pin or bolt 85. In this manner, the pin or bolt 85 can be latched and unlatched. A variant is shown in FIG. 13 in that a latch 91.1 is secured to the pin or bolt 85 and a spring element 89.1 is secured to the gripper holder 68.

A second exemplary embodiment of the apparatus constructed according to the invention is illustrated in FIG. 14 as a completely different flyer doffer or doffing apparatus 20.1, in which various parts are shown in a superimposed arrangement. A carrier 21.1, illustrated here in double for ease in understanding, is separated from a stationary or immovable transit beam 95. A slide block 55.1 is substantially vertically movable in an associated sectional support 23*b*, for example, by means of the screw spindle 57 not particularly illustrated in FIG. 14. The inclined path of motion 15*b* is hingedly and adjustably connected to the slide block 55.1 by means of a hydraulic or pneumatic cylinder 96. The carrier 21.1 is movable by means of a sliding or rolling element 97 and a cylinder 63.1 at this inclined path of motion 15*b*, which can be pivoted into the substantially vertical path of motion 15*a*. Additional retaining or holding means in the form of inflatable cuff grippers 99 constituting pneumatically actuatable gripping means are arranged on both sides of a holding beam 101 and cooperate with the gripping elements 34 of the stationary transit beam 95. With regard to the design of the inflatable cuff grippers 99 and the nature of their mounting on the holding beam 101, reference is made to European Patent Application No. 0,303,877, published Feb. 22, 1989 (and the cognate U.S. patent application Ser. No. 07/233,564). The holding beam 101 can be either fixed in the longitudinal direction of the flyer as illustrated in the right-hand half of FIG. 15 or structured such that it is displaceable through at least a half pitch 36 as depicted in the left-hand half of FIG. 15. In the latter case the longitudinal displacement device can comprise a toothed bar 103 on the holding beam 101 and a driveable pinion 104 on the retaining arm 105. Empty bobbins or tubes 11 as well as full bobbins 10 can be picked up by means of the inflatable cuff grippers 99. The same number of grippers or twice the number of grippers can be provided on the holding beam 101, always in relation to the number of spindles 13 at the tiltable bobbin rail 6. In the event of twice the number of grippers 99 and 99.1, separate air lines 107 and 107.1 would be required. The additional grippers 99.1, which are made somewhat smaller than the inflatable cuff grippers 99 because of space conditions, are depicted or indicated in broken lines in FIG. 15.

Figure 19:
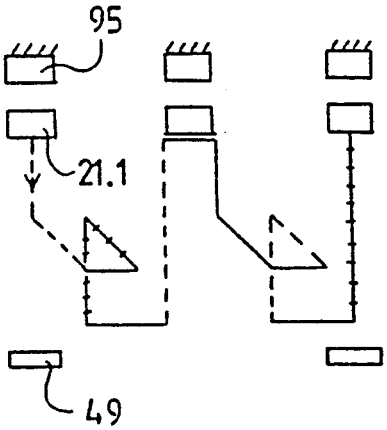
FIG. 19 is a diagram showing the sequence of movements during the doffing procedure carried out with the aid of interim storing in the flyer doffer depicted in FIGS. 14 and 15.

The mode of operation of the second exemplary embodiment of the apparatus constructed according to the invention will now be discussed in greater detail in conjunction with FIGS. 14 and 19 and is as follows:

The carrier 21.1 travels empty, at first along the substantially vertical path of motion 15*a* and then along the inclined path of motion 15*b*, picks up the full bobbins 10 with the inflatable cuff grippers 99 being guided over the full bobbins 10 from above, and places the latter in the interim or intermediate storing location 49. The empty carrier 21.1 subsequently collects the empty bobbins or tubes 11 from the stationary transit beam 95 with the inflatable cuff grippers 99 being guided over the empty bobbin or tubes 11 from above. Therefore, attention should be paid to the fact that the dimension of any possible flange at the bottom end of the bobbin may have to be reduced. The empty bobbins or tubes 11 are brought again via the vertical path of motion 15*a* and the inclined path of motion 15*b* into the inclined position and are deposited onto the spindles 13. The full bobbins 10 are subsequently guided during a substantially upward travel from the interim or intermediate storing location 49 to the stationary transit beam 95. Any longitudinal displacements are unnecessary in this case.

Figure 20:
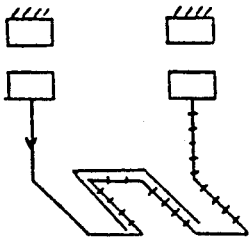
FIG. 20 is a diagram showing the sequence of movements of the doffing procedure without the aid of interim storing in the flyer doffer depicted in FIGS. 14 and 15.
Figure 21:
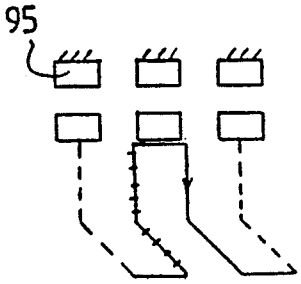
FIG. 21 is a diagram similar to the diagram in FIG. 20 but depicting an alternative mode of operation.

Another mode of operation is illustrated in FIG. 20. It is analogously carried out in accordance with the description of the diagram in FIG. 18. FIG. 21 shows a further mode of operation which is briefly considered as follows:

The carrier 21.1 travels empty into the inclined position, collects the full bobbins 10 and transfers the latter to the stationary transit beam 95. Picking up the empty bobbins or tubes 11 is then essentially simultaneously effected with the discharge of the full bobbins 10.

Figure 17:
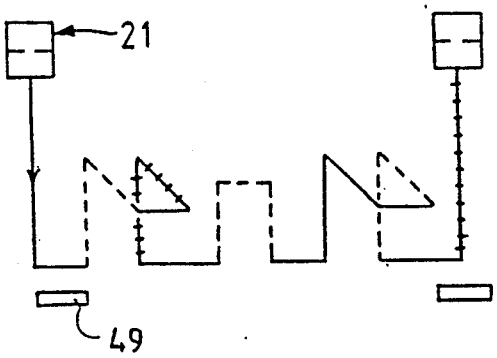
FIG. 17 is a diagram showing the sequence of movements during the doffing procedure carried out with the aid of interim storing in the flyer doffer depicted in FIGS. 1 and 7.

It should be clear that the mode of operation illustrated in FIG. 17 can be straightforwardly carried out by means of the doffer or doffing apparatus 20 depicted in FIG. 1 when the inclined path of motion 15*b* is pivotably connected with the substantially vertical path of motion 15*a* instead of being fixedly connected thereto.

In order to provide a still better understanding of the inventive method, a comparison with the prior art is schematically illustrated in FIGS. 16 through 21. It should be noted that, apart from the horizontal connecting lines which do not represent motion or travel, a continuous line signifies the transport of empty bobbins or tubes 11 and a continuous line with transverse hatching represents the transport of full bobbins 10. A broken line signifies that the carrier 21 or 21.1 or a doffing carriage 106 (FIG. 16) is moved without bobbins.

Figure 16:
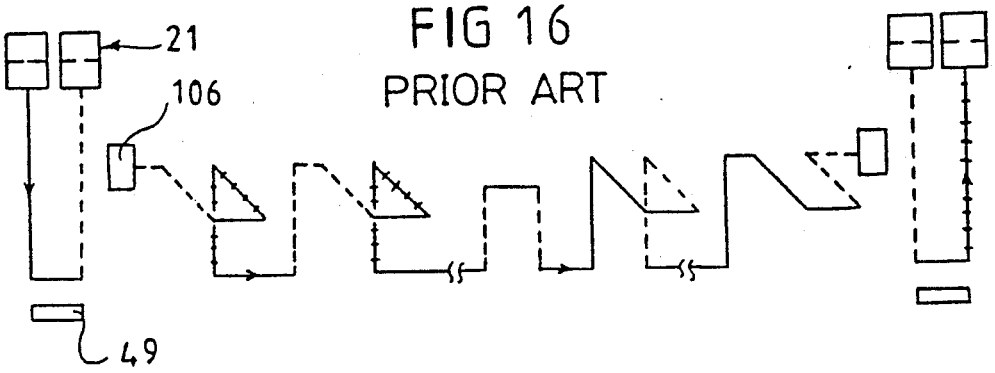
FIG 16 PRIOR ART
FIG. 16 is a diagram showing the sequence of movements during the doffing procedure in accordance with prior art methods as disclosed, for example, in the aforementioned U.S. Pat. No. 4,757,679.

The following points have been considered in the comparison of the prior art method steps depicted in FIG. 16 with the inventive steps depicted in FIGS. 17 through 21:

1.1 Is the transit beam integrated with the carrier 21?

1.2 What is the number of gripper means or gripping elements 34 at the carrier 21? Such number is in relation to that of the spindles 13 at the tiltable bobbin rail 6.

1.3 Is the carrier 21 or 21.1 longitudinally displaceable in the inclined position by a half pitch 36?

2.1 Is the transit beam 95 separate from the carrier 21.1?

2.2 What is the number of inflatable cuff grippers 99 or 99.1 at the carrier 21.1?

2.3 What is the number of gripping elements 34 at the transit beam 95?

3.1 Is an interim or intermediate storing location 49 necessary?

3.2 What is the number of pegs at the interim or intermediate storing location 49?

3.3 Is a longitudinal displacement of the interim or intermediate storing location necessary?

| Fig. | 16 | 17** | 18 | 19 | 20 | 21 |
|---|---|---|---|---|---|---|
| 1.1 | yes | yes | yes | no | no | no |
| 1.2 | same | same | double | — | — | — |
| 1.3 | no | needless* | yes | no | yes | needless* |
| 2.1 | no | no | no | yes | yes | yes |
| 2.2 | — | — | — | same | double | double |
| 2.3 | — | — | — | same | same | double |
| 3.1 | yes | yes | no | yes | no | no |
| 3.2 | double | double | — | same | — | — |
| 3.3 | yes | no | — | no | — | — |

*The longitudinal displacement takes place in the horizontal position.
**A longitudinal displacement is necessary four times.

While there are shown and described present preferred embodiments of the invention, it is to be distinctly understood that the invention is not limited thereto, but may be otherwise variously embodied and practiced within the scope of the following claims.

Accordingly, what I claim is:

1. A method of automatically replacing full bobbins by empty bobbins at a roving frame, said method comprising the steps of:

moving all of the full bobbins present at the roving frame from a substantially vertical operating position to an inclined position;

moving a plural number of empty bobbins equal to the number of all of said full bobbins from a substantially vertical position into an inclined position;

lifting all of said full bobbins in their inclined position to doff all of said full bobbins;

lowering all of the plural number of empty bobbins in their inclined position and bringing all of said plural number of empty bobbins into a substantially vertical operating position;

said step of lifting all of said full bobbins and said steps of moving and lowering all of said plural number of empty bobbins, entailing the use of a doffing and donning apparatus separate from the roving frame;

said step of lifting all of said full bobbins from their inclined position entailing the step of jointly withdrawing all of said full bobbins which have been moved into their inclined position, out of their inclined position by means of a carrier of said doffing and donning apparatus;

said step of lowering all of said plural numbers of empty bobbins in their inclined position entailing the step of jointly bringing all of said plural number of empty bobbins from their substantially vertical position into their inclined position by means of said carrier of said doffing and donning apparatus;

during said step of jointly bringing all of said plural number of empty bobbins from their substantially vertical position into their inclined position by means of said carrier, lowering all of said plural number of empty bobbins out of a substantially vertical transport-starting position along a substantially vertical path of motion and storing all of said plural number of empty bobbins at an interim storing location;

bringing the empty carrier from said interim storing location into an inclined path of motion to receive all of said full bobbins in their inclined position;

during said step of jointly withdrawing all of said full bobbins which have been moved into their inclined position, out of their inclined position by means of said carrier, storing all of said full bobbins at said interim storing location;

engaging all of said plural number of empty bobbins at said interim storing location by means of said carrier and bringing all of said plural number of empty bobbins from said interim storing location into their inclined position; and engaging all of said full bobbins at said interim storing location by means of said carrier and lifting all of said full bobbins from said interim storing location into a substantially vertical discharge position.

2. An apparatus for automatically replacing full bobbins by empty bobbins at a roving frame provided with a bobbin rail which is tiltable into an inclined position and comprises a predeterminate number of spindles having a predetermined pitch for receiving a predeterminate number of bobbins, comprising:

a doffing and donning device separate from the roving frame which has a predetermined working length in a predetermined longitudinal direction;

said doffing and donning device comprising a carrier which extends over the entire predetermined working length of the roving frame;

a predeterminate number of gripping means provided at said carrier and being at least equal to the predeterminate number of spindles at the bobbin rail;

a substantially vertical path of motion combined with an inclined path of motion for said carrier;

the inclination of said inclined path of motion corresponding with that of said inclined position of the tiltable bobbin rail;

drive means for moving said carrier along said substantially vertical path of motion and said inclined path of motion during a doffing and donning operation carried out by said doffing and donning device;

at least two guide rails:

said carrier being movable at said at least two guide rails;

said at least two guide rails defining said substantially vertical path of motion and said inclined path of motion; and said guide rail defining said inclined path of motion being pivotably connected with said guide rail defining said substantially vertical path of motion.

3. An apparatus for automatically replacing full bobbins by empty bobbins at a roving frame provided with a bobbin rail which is tiltable into an inclined position and comprises a predeterminate number of spindles having a predetermined pitch for receiving a predeterminate number of bobbins, comprising:

a doffing and donning device separate from the roving frame which has a predetermined working length in a predetermined longitudinal direction;

said doffing and donning device comprising a carrier which extends over the entire predetermined working length of the roving frame;

a predeterminate number of gripping means provided at said carrier and being at least equal to the predeterminate number of spindles at the bobbin rail;

a substantially vertical path of motion combined with an inclined path of motion for said carrier;

the inclination of said inclined path of motion corresponding with that of said inclined position of the tiltable bobbin rail;

drive means for moving said carrier along said substantially vertical path of motion and said inclined path of motion during a doffing and donning operation carried out by said doffing and donning device;

an interim storing location for interim storage of bobbins;

said interim storing location containing a predetermined number of bobbin storing elements and which predetermined number is twice as great as said predeterminate number of spindles at said bobbin rail;

said bobbin storing elements at said interim storing location being spaced from each other at half said pitch of said spindles at said bobbin rail;

said predeterminate number of gripping means at said carrier being substantially equal to said predeterminate number of spindles at said bobbin rail;

said drive means for moving said carrier along said substantially vertical path of motion and said inclined path of motion, moving said carrier in a predetermined sequence of motions between a predetermined position, at which empty bobbins are received and full bobbins are discharged, the interim storing location and the bobbin rail tilted into said inclined position; and said drive means containing displacement means for reversibly displacing said carrier in said predetermined longitudinal direction of said roving frame by an amount which is substantially equal to half said pitch of said spindles at said bobbin rail.

4. An apparatus for automatically replacing full bobbins by empty bobbins at a roving frame provided with a bobbin rail which is tiltable into an inclined position and comprises a predeterminate number of spindles having a predetermined pitch for receiving a predeterminate number of bobbins, comprising:

a doffing and donning device separate from the roving frame which has a predetermined working length in a predetermined longitudinal direction;

said doffing and donning device comprising a carrier which extends over the entire predetermined working length of the roving frame;

a predeterminate number of gripping means provided at said carrier and being at least equal to the predeterminate number of spindles at the bobbin rail;

a substantially vertical path of motion combined with an inclined path of motion for said carrier;

the inclination of said path of motion corresponding with that of said inclined position of the tiltable bobbin rail;

drive means for moving said carrier along said substantially vertical path of motion and said inclined path of motion during a doffing and donning operation carried out by said doffing and donning device;

said predeterminate number of gripping means at said carrier being substantially equal to twice said predeterminate number of spindles at said bobbin rail;

said predeterminate number of gripping means being spaced from each other at substantially half the pitch of said spindles at said bobbin rail;

said drive means for moving said carrier along said substantially vertical path of motion and said inclined path of motion, moving said carrier in a predetermined sequence of motions between a predetermined position, at which empty bobbins are received and full bobbins are discharged, and the bobbin rail tilted into said inclined position; and said drive means containing displacement means for reversibly displacing said carrier in said predetermined longitudinal direction of said roving frame by an amount which is substantially equal to half said pitch of said spindles at said bobbin rail.

* * * * *